United States Patent [19]

Nemtsov et al.

[11] 4,143,777

[45] Mar. 13, 1979

[54] BLAST FURNACE CHARGING DEVICE

[75] Inventors: Nikolai S. Nemtsov; Viktor I. Vasiliev; Vladimir P. Tarasov; Stanislav T. Pliskanovsky; Anatoly A. Shokul; Anatoly P. Kravchenko; Fedor V. Kraizinger; Ivan I. Krjukov, all of Zhdanov Donetskoi oblasti, U.S.S.R.

[73] Assignee: Zhdanovsky Metallurgichesky Institut, Zhdanov, U.S.S.R.

[21] Appl. No.: 838,721

[22] Filed: Oct. 6, 1977

[51] Int. Cl.[2] ..... F27B 11/12

[52] U.S. Cl. ..... 414/170; 222/502; 414/201

[58] Field of Search ..... 214/35-37; 266/184; 222/502

[56] References Cited

U.S. PATENT DOCUMENTS

| | | | |
|---|---|---|---|
| 2,671,017 | 3/1954 | McCutcheon | 214/36 X |
| 3,009,691 | 11/1961 | Tsujihata et al. | 214/36 X |

*Primary Examiner*—Robert G. Sheridan

*Attorney, Agent, or Firm*—Lackenbach, Lilling & Siegel

[57] ABSTRACT

A charging device comprising a receiving hopper with an outlet through which passes a rod carrying a bell adapted to close the outlet of a hopper located above a furnace. Mounted on the receiving hopper from below is an appliance for adjusting the cross-sectional area and shape of the hopper outlet, the appliance including sector shields fixed in guideways, forming a hopper-shaped surface and associated with their longitudinal transfer drive. A rod is provided along the axis of said hopper with guard rings, one of which rings is tapered and disposed at the bottom edge of the sector shields.

9 Claims, 15 Drawing Figures

BLAST FURNACE CHARGING DEVICE

BACKGROUND OF THE INVENTION

The present invention relates to blast furnace equipment, and more particularly to charging devices.

For example, there is known in the art a blast furnace charging device which is a combination of a McKee distributor and two Parry bell-and-hopper arrangements mounted one above the other and fitted with bell rods. Upon dumping each skipload the upper hopper is turned through a preset angle thereby diminishing to a certain extent but not eliminating completely the negative influence of distributing the charge in heaps peculiar to this type of charging apparatus. As a result, both the chemical and heat energy of reducing gases is under utilized. Another disadvantage of this prior-art charging device lies in that it fails to provide reliable control over radial distribution of charge at a furnace top.

There is also known in the art a charging device comprising a bottom bell with a fixed hopper and a top bell with a rotary hopper. Mounted above the top bell is a sealing valve-cover (see e.g., French Pat. No. 1240287).

The valve of the patent referred to above has a soft packing between its tapered surface and the top portion of the rotary hopper, and a labyrinth packing around the bell rod. When loading a belt-fed charge, the cover is raised. Upon feeding a full batch of the charge, the cover is closed and the charge is lowered into a blast furnace. Said charging device is characterized by a sophisticated design and fails to provide reliable functioning of the blast furnace at a high top gas pressure.

Known as well in the art is a charge distributor (see, e.g., Inventor's Certificate of the USSR No. 132652) comprising two large Parry bells with fixed hoppers. To enable uniform peripheral distribution of the charge at a furnace top arranged above the upper hopper is a rotary hopper, whose internal surface is fitted with inclined blades, said rotary hopper being mounted beneath a movable hopper driven along horizontal guideways so that its outlet can be disposed in a corresponding place of the rotary hopper. Such a design enables a requisite irregular charging to be achieved for various sectors of the furnace top.

However, this charging device is characterized by extremely severe operating conditions of its equipment, a drive and support rollers of the bladed rotary hopper in particular, whereby it is impossible to attain a speed above 18 rpm. Yet, even at this speed there arise undue efforts as the charge is accumulated in heaps up to ten tons in weight on one side of the rotary hopper. As a result, the rollers and races adapted to carry such heavy heaps of charge fail after one or two months of operation, with the rotary hopper being incapable of attaining such angular speed at which the requisite uniform peripheral distribution of the charge is ensured.

The Inventor's Certificate of the USSR No. 105602 describes a charging device with a charge distributor, said device comprising two bells with fixed hoppers and rods, above which a receiving hopper is arranged. Mounted intermediate of said receiving hopper and the top bell is a rotary hopper with two sloping surfaces and two outlets. Upon leaving the receiving hopper the charge is admitted onto the rotary hopper wherefrom it drops through the two outlets to be uniformly spread over on the top bell. However, in the course of functioning of said charging device there may take place a hanging of the charge in the rotary hopper, which may be responsible for the blast furnace banking.

Moreover, the provision of two outlets in the hopper makes it impossible to concentrate the charge, if necessary, in a particular preset sector at the furnace top.

Another prior-art charging device (see, e.g., Japanese Pat. No. 7809) comprises two bells with fixed hoppers. Arranged above the upper hopper are two plate valves with a bunker being located therebelow, the bunker outlet being narrowed and its walls formed with guide blades. The valves are fitted with a soft rubber packing. With the valves being open, the plates are drawn out of the flow of a dropping charge to be thereby saved from wearing which may be caused by the moving stock. A small bell rod is lined with the aid of guard rings and has a packing in a gas seal. However, a considerable height of this device has turned out to be a serious problem. Therefore, the same firm has proposed another embodiment of a bell-and-hopper arrangement (see, Japanese Pat. No. 7808), with a bottom bell having two rods located eccentrically to the longitudinal axis of the furnace. The disadvantage of the charging devices with the plate valves resides in that they require a thorough sizing of the charge to preclude the ingress of large lumps. The use of unsorted charge leads to a strongly pronounced peripheral segregation, a feature diminishing materially the economic effect of the blast furnace process.

The disadvantage inherent in the above outlined charging devices consists in that they fail to provide for efficient control of the radial charge distribution at the furnace top. To enable said efficient control of the radial distribution of charge at the furnace top, there have been developed manipulators with movable plates, disclosed in GFR Pat. Nos. 1221255, 1250463, 1206454, 1229565, 1230051 and 1231734. As can be seen from the disclosure of the above patents, mounted round the entire circumference of the furnace top are driven plates capable of being transferred radially at the furnace top, thereby varying its diameter. This affords the possibility of changing the arrangement of a charge cone top and radial burden distribution. The disadvantage of said device lies in its large overall dimensions, which complicates the construction of the furnace top, and its low reliability in service. This equipment operates under severe conditions, specifically by a high temperature, dust-laden atmosphere and high gas pressure.

Also known in the art is a charging device comprising bunkers with upper and lower gate valves and adapted for efficient control of both radial and peripheral charge distribution at a furnace top. Arranged beneath the bunkers is a driven pan (see, e.g., GFR Pat. No. 126614 and Czechoslovakian Pat. No. 88154). As the charge is being poured down, the pan can be either rotated or placed in any assigned sector, this feature providing for the requisite peripheral and radial distribution of the charge. The disadvantage of said device resides in its low functional reliability. In the case a rotary gear fails, the charging of a blast furnace shall cease, insofar as the fines, contained in the charge, will accumulate in one sector of the furnace top. As for using unsorted charge, it does not ensure the requisite regular peripheral dispensing of the charge.

There is likewise known a blast furnace charging device comprising a large and a small bell with hoppers and rods. Mounted above the bell is a receiving hopper with an appliance for adjusting its outlet area (see, e.g., Inventor's Certificate of the USSR No. 374374). In terms of its geometry the appliance is shaped as plates fitted with counterweights and articulated around the outlet. As the charge passes through the outlet, its flow is constricted under the action of said plates, the charge being therefore concentrated around the rod. This feature contributes to an averaged peripheral distribution of the charge. The disadvantage of this charging device is apparent when the charge is traveling the plates may jam, being registered in that position and distorting therefore the preset configuration of the outlet. Moreover, the device fails to provide charge accumulation in the assigned sector of a furnace top. It is also not able to adjust radial charge distribution at the furnace top.

A great number of patents granted for various constructions of blast furnace charging devices are indicative of extreme importance of the problem, which has been and is attracting the attention and efforts of a considerable number of those skilled in the art and engaged in providing substantial improvements in the prior-art developments.

The main object of the present invention is the provision of a blast furnace charging device which would be simpler in terms of its design and more reliable and durable in service than the prior-art devices of similar application.

Another no less important object of this invention is to provide better charge distributing at a furnace top in terms of both more regular peripheral distribution and charging a batch into a preset section at the furnace top.

Still another important object of the invention is to decrease the overall dimensions of a large bell and its hopper and to reduce gas and dust release through the furnace charging device.

These and other objects are achieved by providing a blast furnace charging device, comprising a receiving hopper with an appliance for adjusting the clear passage of its outlet, with at least a single rod, fitted with guard rings and running concordantly to the longitudinal axis of said hopper, said rod being suspended from coupling rods and carrying a bell adapted to close the outlet of a hopper located above a furnace top, wherein, according to the invention, the appliance for adjusting the cross-sectional area and shape of the receiving hopper outlet is made as sector shields forming a hopper-shaped surface with an annular adjustable gap around the tapered guard ring set on the rod, said sector shields being fixed in guideways and linked mechanically with their longitudinal transfer drives.

The present charging device makes it possible to improve charge distributing at the furnace top by both more regular peripheral distribution and by charging a batch into a preset section of said furnace top; it allows also simplifying the design of said charging device, enhancing the functional reliability of its gears and their longevity and decreasing gas and dust release through said charging device.

It is preferable that the appliance for adjusting the clear passage of the receiving hopper outlet comprise from 2 to 12 sector shields.

The appliance made up of said number of the sector shields is more convenient in terms of their control and features a simpler design.

The bottom edges of said sector shields are advisable to be of such a size as to provide said annular gap around the rod guard ring, the gap being at least 1.5 times less than that between the bottom edge of the receiving hopper outlet and the rod guard rings, but exceeding in size a gap which may cause the hanging of charge in said receiving hopper.

Such a design would obviate the hanging of the charge in the receiving hopper, provide for uniform peripheral distribution of the charge at the furnace top and enhance the reliability of operation of a blast furnace.

It is preferred that the tapered guard ring be made as a distributing bell and be linked mechanically with a gear adapted to transfer it along the rod.

Such an embodiment of the guard ring would provide better control of radial charge distributing at the furnace top without resorting to cumbersome gears to be arranged inside a blast furnace; it allows also simplifying the construction of the charging device and, which is of prime importance, cutting down the overall dimensions of the large bell and its hopper.

The top part of said distributing bell can mount a cylindrical guard ring, said ring being located beneath another guard ring, whose external surface has a configuration of one-sheet hyperboloid of revolution.

This will make it possible to deflect the flow of charge, bringing it closer to the longitudinal axis of the charging device and enhancing thereby the uniformity of its peripheral distribution at the furnace top.

It would be preferable, if the appliance for adjusting the clear passage of the receiving hopper outlet is equipped with a sensor capable of traveling along the coupling rod of the bell rod, being actuated in case the hanging of charge occurs and delivering a signal to the actuating gear of the sector shield transfer drive.

It would avoid the overloading of the receiving hopper, raising (drawing apart) the sector shields with the aid of their drives and eliminating the charge hanging in the receiving hopper; it would also enhance the reliability and longevity of operation of the charging device.

It is sound practice that the bottom edge of the receiving hopper be fitted with projections shaped as isosceles triangles with appropriate lateral sides of said triangles running parallel to the adjoining parts of the side edges of the adjacent sector shields.

Owing to the use of said projections the design of the proposed charging device can be made simpler, the overall dimensions of the sector shields reduced and their transfer drive ratings cut down.

Each of said sector shields can be made as a frame with strips in a wear-resistant material secured thereon.

The strips can be replaced as they wear out, or the strips of appropriate dimensions can be placed with a view to adjusting the annular gap between the rod guard rings and the bottom edges of the sector shields, which would allow taking into account both the charge size and its chemical composition.

It is preferable that each of said sector shield guideways have a narrowed part adjoining the running gear of the appropriate sector shield.

The provision of said guideways would make it possible to avoid the wedging of the sector shields during their travel, enhancing thereby their functional dependability.

It would be favorable if the end portions of said guideways have holes, with a pivot being introduced into each of said holes, said pivot being provided with a detent that is registered in a preset position, shaped as a helix and capable of interacting with the sector shield running gear.

Such a design allows adjusting the extreme positions of the shields and the outlet configuration, providing for more regular peripheral distribution of the charge at the furnace top.

The present invention will be better understood from a consideration of a detailed description of exemplary embodiments of a blast furnace charging device to be had in conjunction with the accompanying drawings, in which:

FIG. 1 shows a blast furnace charging device; a section by a vertical plane through a longitudinal axis;

FIG. 2-scaled-up section II–II of FIG. 1;

Figure 8:
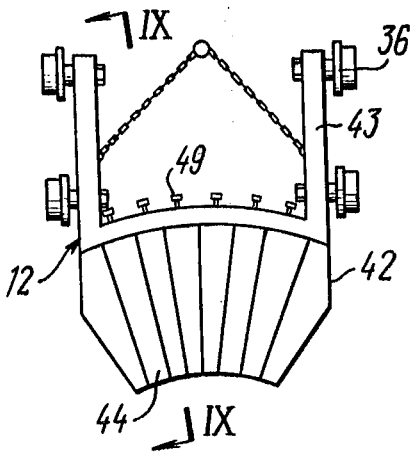
FIG. 8 is a top view of a sector shield.
Figure 9:
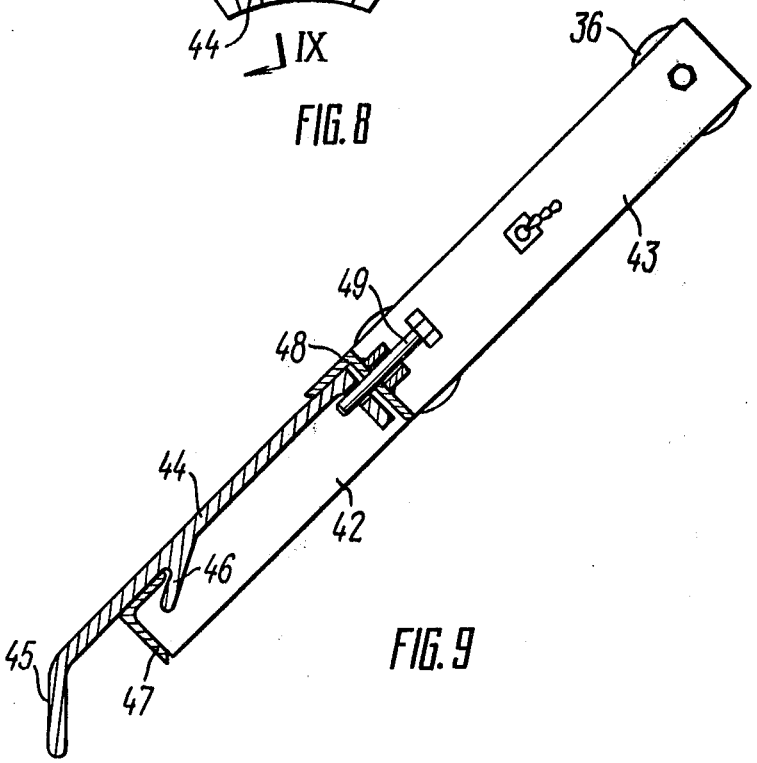
Figure 10:
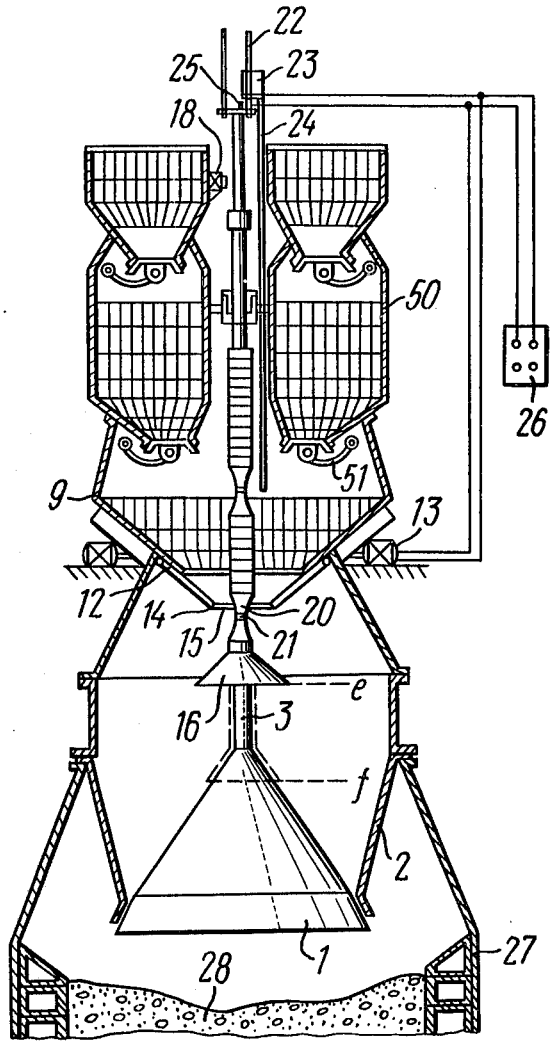
Figure 11:
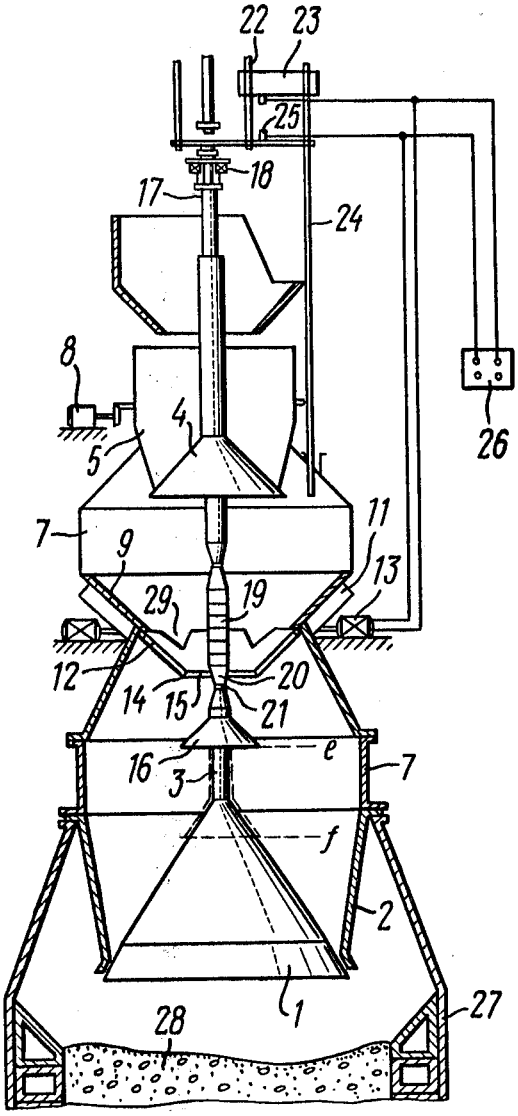
Figure 12:
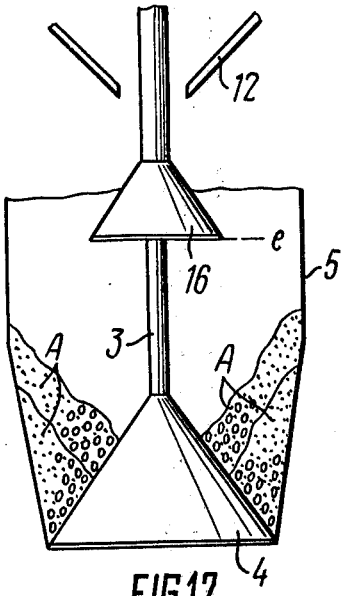
Figure 13:
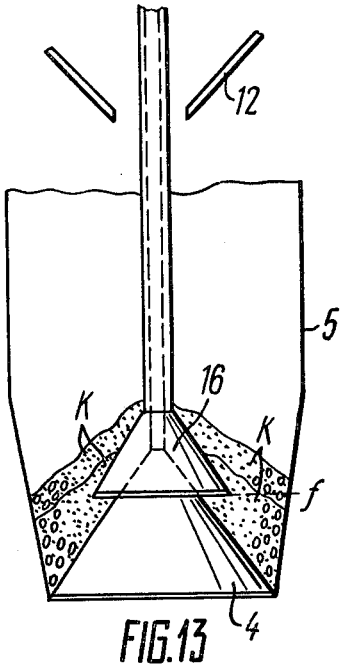
Figure 14:
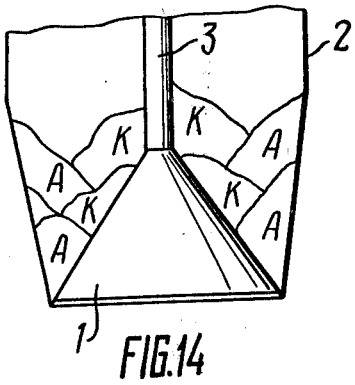
Figure 15:
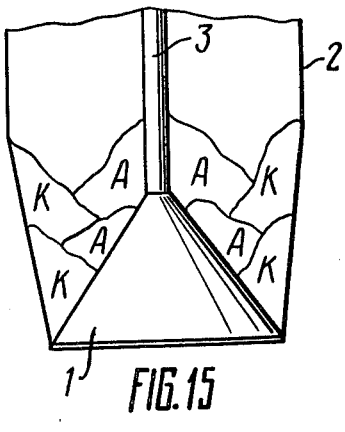

FIG. 9 - section IX—IX of FIG. 8;

FIG. 10 depicts a charging device with an appliance for adjusting the clear passage of a receiving hopper outlet, with a plurality of bunkers arranged above said receiving hopper;

FIG. 11 illustrates a charging device with an appliance for adjusting the clear passage of a hopper mounted above a large bell;

FIG. 12 is a scaled-up diagrammatic view of charge distribution on a small bell and a distributing bell in its upper (raised) position;

FIG. 13 shows the same members as those illustrated in FIG. 12 but with the distributing bell in its lower (dropped) position;

FIG. 14 shows a large bell with a hopper and burden distributing pattern upon charging sinter (A) with the raised distributing bell and coke (K) with the lowered bell;

FIG. 15 shows burden distributing pattern on the large bell and hopper upon charging coke (K) with the raised distributing bell and sinter (A) with the lowered bell.

Figure 1:
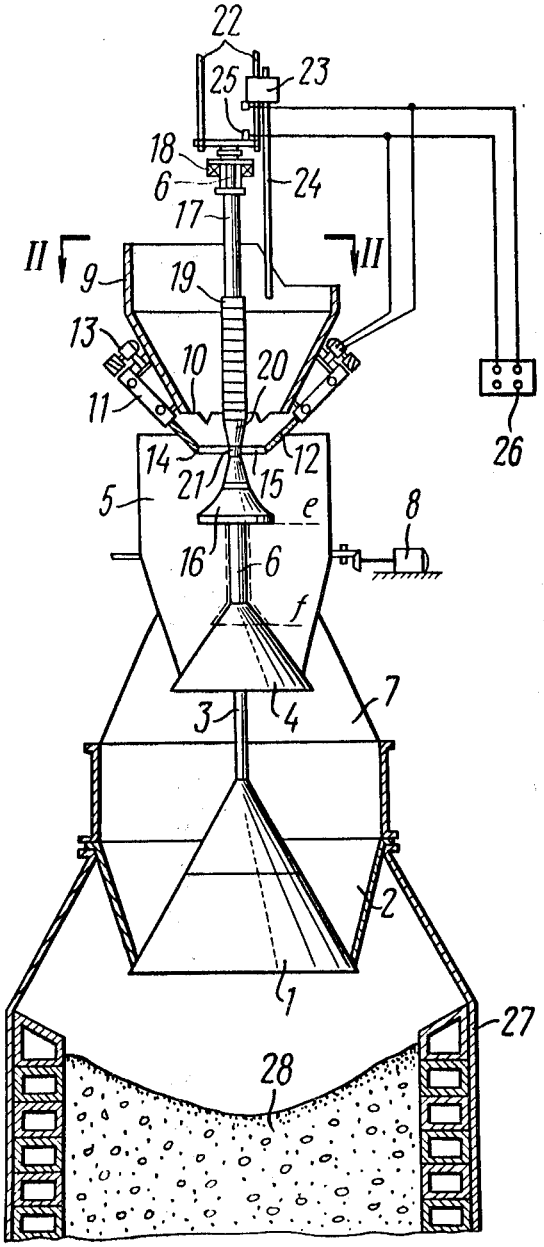
Figure 3:
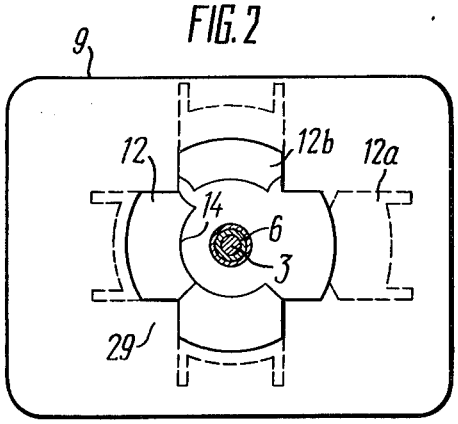
FIG. 3 depicts sector shields, of which one is completely drawn back and the other one is raised a little.
Figure 4:
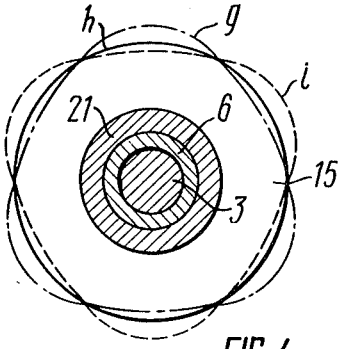
FIG. 4 shows a scaled-up view of an annular gap between rod guard rings and the bottom edges of the appliance sector shields.

A charging device comprises a large bell 1 (FIG. 1) with a hopper 2, suspended from a rod 3, and a top small bell 4 with a hopper 5, suspended from a hollow rod 6, into which said rod 3 extends. Mounted above the hopper 2 is a bottom airlock chamber with a sealing gas lock 7. The hopper 5 is fitted with a drive 8 adapted for rotating it about its longitudinal axis. Above the hopper 5 there is a receiving hopper 9 with a bottom outlet 10, whereat is disposed an appliance for adjusting both the cross-sectional area (clear passage) and shape of said outlet 10. Said appliance is rigidly fixed on the external surface of the receiving hopper 9 by means of guideways 11, in which are fixed sector shields **12*a* and 12*b* (FIGS. 2 and 3), forming a hopper-shaped surface. Said sector shields 12*a* and 12*b* are furnished with longitudinal transfer drives 13 (FIG. 1). The guideways 11 are angled to the longitudinal axis of the hopper 9. The appliance may comprise from two to twelve sector shields 12. Bottom edges 14 (FIGS. 2 and 3) of the sector shields 12 form around the coaxial rods 3 and 6 (FIG. 4) an annular opening 15 for the passage of a charge (with the sector shields 12 brought apart), said opening 15 being narrowed to the size of an annular gap 15 as the shields 12 are brought together. At the level corresponding to the bottom position of the edges 14 (FIG. 5) of the sector 12 there is a distributing bell 16, suspended from the rod 6. Said bell 16 is linked mechanically through a coupling rod 17 with a drive 18 adapted for shifting the bell vertically. Guard rings 19 in a wear-resistant material are set on the coupling rod 17. At the level of the annular gap 15 (between the bottom edges 14 of the sector shields 12 and guard rings 19 of the rod 6) the coupling rod 17 has another guard ring 20, whose external surface is shaped a one sheet hyperboloid of revolution, with a cylindrical guard ring 21 mounted thereabove. The coupling rod 17 may be provided with one more pair of the guard rings 20 and 21 spaced from the first pair at a distance equal to the stroke of the bell 16**.

The edges 14 of the sector shields 12, lateral sides of the guard rings 20 and 21 as well as the distributing bell 16 can be also either coated with a wear-resistant material, such as a hard metal alloy composition, or made of a wear-resistant material, such as a hard metal alloy. The rods 3 and 6 are suspended from appropriate coupling rods 22, whereon charge hanging sensors 23 and rod 24 are arranged, with the rod 24 overhanging into the space of the receiving hopper 9. The rod 24 is capable of travelling along the coupling rod 22. The sensor 23 is electrically associated with a contact 25 fixed on the coupling rod 22, the contact 25 being in turn associated electrically with a control panel 26 (FIG. 1) of the charging device and with the drives 13 of the sector shields 12.

Figure 2:
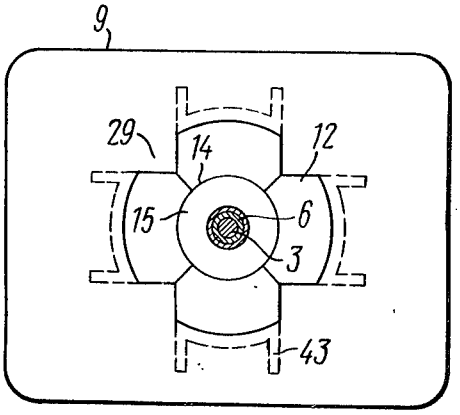

Arranged under the bottom bell 1 is a blast-furnace top 27, wherein the charge level is identified by item 28. The lower edge of the outlet 10 (FIG. 5) of the receiving hopper 9 can be either shaped as a circumference or fitted with projections 29 in the form of isosceles triangles, with appropriate lateral sides of said triangles running parallel to the adjoining parts on the lateral sides of the adjacent sector shields 12 (FIG. 2).

Figure 5:
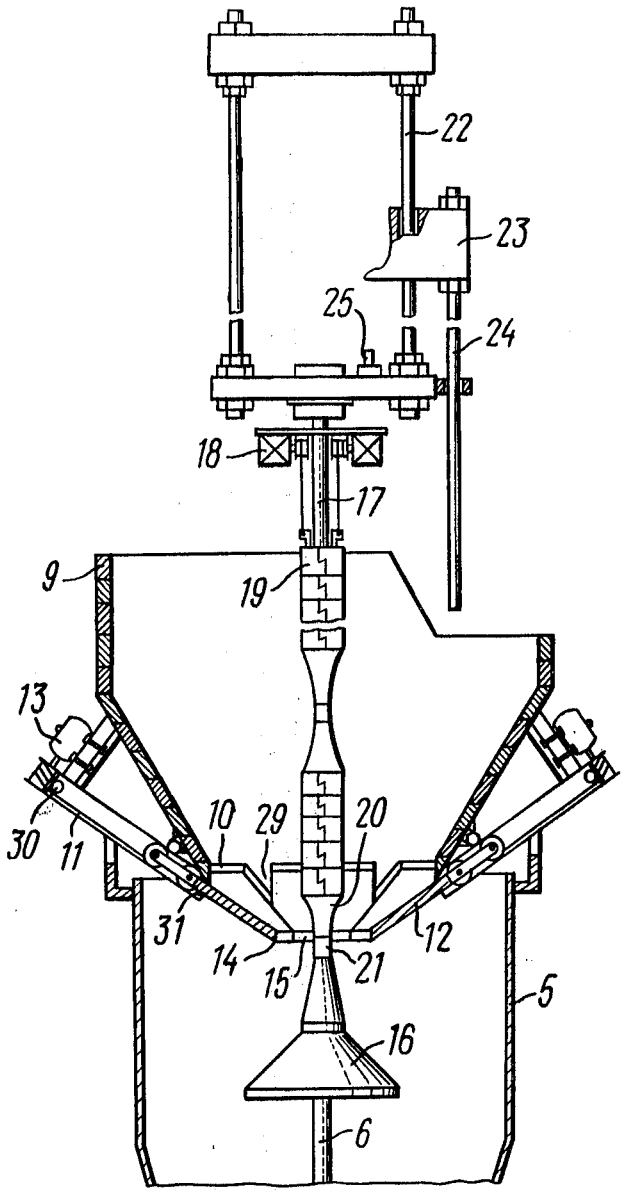
FIG. 5 illustrates a receiving hopper with an appliance for adjusting its outlet size, a scaled-up section by a vertical plane.
Figure 6:
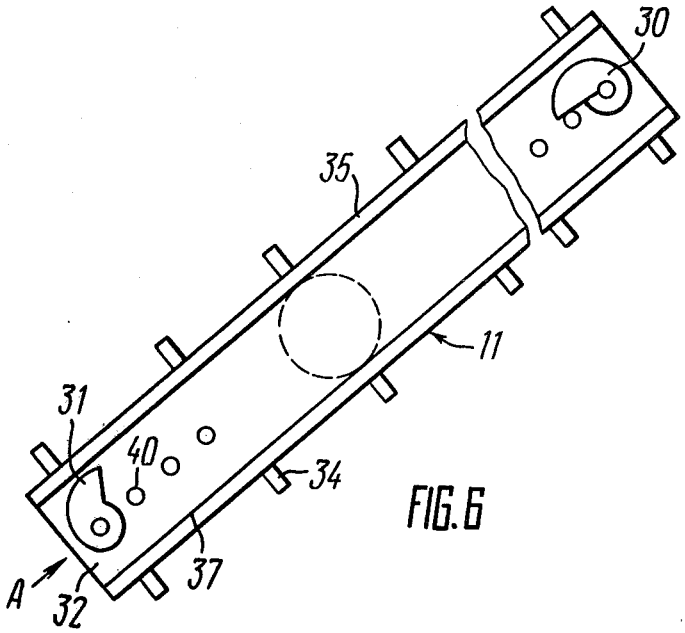
FIG. 6 is a conventional scaled-up side view of one of appliance guideways with a broken out section.
Figure 7:
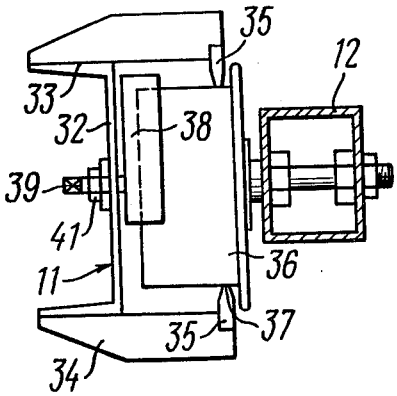
FIG. 7 shows a conventional scaled-up view of one of the guideways (a view along arrow A of FIG. 6)

The guideways 11 (FIG. 6) are provided with top detents 30 and bottom detents 31 that are fixed thereon to limit the stroke of the sector shields 12 (FIG. 7). The top detents 30 (FIG. 6) are located so that the bottom edges 14 (FIG. 2) of the sector shields 12 in their extreme top position are arranged level with or above the bottom edge bounding the outlet 10 (FIG. 5) of the receiving hopper 9. The bottom detents 31 (FIG. 6) are disposed so that the sector shields 12 (FIG. 2) in their extreme bottom (lowered) position are brought together, with their bottom edges 14 forming the annular gap 15 around the guard ring 21 (FIG. 5). The bottom edges 14 of the sector shields 12 can be arcuated. If that is the case, on being drawn together they can form either a circumference (h) (FIG. 4) or a line (g), for which the deflection of its points from the radius of said circumference towards the larger values is the greater, the more the curve (i) on the circle charge distributing diagram deviates, in case of a round opening (gap), from its mean value towards the lower ones. And vice versa, the more the distance from the edges 14 (FIG. 5) of the opening (gap) 15 deflects from the value of the radius towards the lower values, the greater the tendency of the distribution curve towards the larger values.

The guideways 11 are made as beams 32 (FIGS. 6 and 7), with plates 34 being secured to their top and bottom lengthwise sides 33 at right angles to their longitudinal axis. Fastened to the ends of the plates 34 parallel to the axis of the beam 32 are bars 35 accommodating running gears 36, referred to hereinafter as runners 36 (FIG. 7), of the sector shields 12, with the cylindrical surface of said runners 36 found in contact with the narrowed sides 37 of the bars 35. The width of said narrowed side 37 shall be minimized proceeding from the most favorable conditions for dropping pulverized charge and precluding the jamming of said runners 36; thus, it should be sufficiently large to prevent the warping of said narrowed side 37 in the course of operation.

As is known, the end parts of the beam 32 (FIG. 6) are fitted with the detents 30 and 31, each of said detents 30 and 31 comprising a head 38 (FIG. 7), made as helix fitted rigidly on a pivot 39 that is introduced into one of appropriate holes 40 (FIG. 6), provided along the beam 32 and spaced apart at a distance equal to the stroke of a rim of the head 38 (FIG. 7) (i.e. to the difference between the maximum and minimum distances from the rim of said head 38 to its pivot 39). The head 38 mounted on the beam 32 is provided with a locator 41 adapted to register said head 38 in a preset position.

The sector shield 12 has a frame (a framework) 42 (FIGS. 8 and 9) made in the form of a truncated cone sector and provided with blades 43 on which the runners 36 are fixed. Fastened to the frame 42 are detachable shaped grate bars 44 made as strips of a wear-resistant material. The bars 44 are the segments of a truncated cone projecting downwards.

The bottom endface edge of each grate bar 44 projects with its curvature 45 (FIG. 9) downwards, its middle part having from below a rib 46, with the grate bars 44 striking with said ribs 46 against the bottom endface collar 47 of the frame 42. The grate bar 44 is secured to a top endface collar 48 by way of a locator 49. The grate bars are abutting tightly against each other forming a continuous surface all over the area of the sector shield 12 (FIG. 8). Use can be also made of a solid sector shield 12, e.g. made as an integral casting which has no runners but is sliding instead along the bars 35 (FIG. 7).

The device of the invention may also prove to be most advantageous in the case when a plurality of bunkers 50 with gas-sealing valves 51 are arranged above the receiving hopper 9 (FIG. 10).

The appliance for adjusting the clear passage of the receiving hopper 9 (FIG. 11) is also adaptable when said receiving hopper is located on a blast furnace above the large bell 1, with the other hoppers being disposed above said receiving hopper 9. According to this invention, the appliance provides for a preset charging of burden constituents: sinter and coke, onto the bell 1 (FIGS. 14 and 15) and in the hopper 2, this being effected with the help of the movable distributing bell 16 (FIGS. 12 and 13).

With a blast furnace operating at a steady rate use can be made of a stationary bell 16 (FIG. 1), fixed on the guard rings 19.

It should be borne in mind that the present invention is in no way limited to the exemplary embodiment disclosed herewith, and various modifications can be resorted to by those skilled in the art as to the layout of various particular units of the charging device, such as fall within the true spirit and scope of the present invention defined in the claims which follow.

The herein-proposed charging device operates in the following manner.

A charge batch (equal in volume to a skipload) is loaded into the blast furnace receiving hopper 9 (FIG. 1). In this case the sector shields 12 are set to their extreme bottom (lowered) position. Upon filling to capacity the space of the receiving hopper 9 the charge is gradually poured through the annular gap 15. Each next batch is charged in a similar manner. As soon as a preset volume of the stock (a complete change) is accumulated in the hopper 5 on the bell 4, the dumping action of the small bell 4 is initiated, the charge being poured into the lower hopper 2 on the bell 1. Another charging schedule is also possible: each batch of the charge (a skipload) or two such batches together being lowered on the bell 1. As the large bell 1 lowers, the charge runs out of the hopper 2 into the top 27 to fill it to the level 28.

As the charge passes through the calibrated narrow annular gap 15, it is regularly distributed round the circumference of the furnace top 27 according to its mass, size and composition (coke, sinter). This feature provides for highly uniform peripheral distribution of the charge at the top 27. The provision of the guard rings 20 and 21, decreasing in diameter at the level of the outlet annular gap 15, contributes to said uniform dispensing action. The external surface of the guard ring 20 similar in configuration to an one-sheet hyperboloid of revolution is conducive to smooth running of the charge through said annular gap 15, whereas the use of the guard ring 21 made as a cylindrical insert of a minimum diameter precludes the jamming of charge lumps in said annular gap 15.

Insofar as at the level of the bottom edge 14 of the sector shields 12 the diameters of the guard rings 20 and 21 decrease as compared with those of the other guard rings 19, it affords the possibility of reducing accordingly the outside diameter of the annular gap 15, the flow of charge being there deflected to the centre of the receiving hopper, which in turn contributes to a more uniform peripheral distributing of the charge at the furnace top 27. To provide for a still greater degree of uniformity in peripheral dispensing of the charge at said furnace top 27 as the charge is being dropped through the annular gap 15, the hopper 5 is capable of being rotated by the drive 8.

The hopper shall turn through a preset angle after a charge batch has been completely poured, but in view of a high degree of uniformity in peripheral distribution of the charge ensured by the proposed charging device, the hopper 5 can remain immovable. Hence the hopper 5 can be made fixed without the drive 8 and a gland seal. In the meantime its capacity can be increased to accommodate a whole round of charges (a batch equal in volume to several skiploads).

In case a stable scaffold is formed in the receiving hopper 9, which takes place quite occasionally, the charge will not run off through the annular gap 15. If that is the case, the rod 24 will strike against the charge surface within the receiving hopper 9, as the bell 4 is lowered, and will not descend together with the coupling rod 22, the contact 25 being thereby broken and delivering a signal to the control panel 28 to raise the sector shields 12 by means of their drives 13.

Upon raising the sector shields 12, the annular gap 15 will increase, the scaffold will break down and the charge will drop into the hopper 5. After that a signal is sent from the control panel 26 through a time relay to lower the sector shields 12 (FIG. 2); the latter will draw together, returning to their initial position.

As the sector shields 12 are being transferred, the runners 36 (FIG. 7) are rolling along the narrowed sides 37 of the bars 35. In spite of extremely dust-laden atmosphere in the place of location of the guideways 11, the dust is not deposited on the narrowed sides 37 of the bars 35. The dust, if accumulated thereon, will be removed from said narrowed sides 37, a feature precluding the wedging of the sector shields 12. Said efficient removal of the dust is ensured because of a small width of the narrowed sides 37, with the runner 36 exerting such a pressure during its travel that the accumulated dust is removed with the material of the narrowed sides 37 not being distorted. The removed dust passes between the plates 34 or gets on their sharp top edges, wherefrom it is free to fall off outside the limits of the guideways 11.

If a greater amount of sinter or coke (FIGS. 14 and 15) contained in the furnace burden, must be fed into a particular sector of the furnace top 27 (FIG. 1) (said sector being located against the sector shield 12*a* (FIG. 3), as compared with that supplied into its other sectors, one or a plurality of the sector shields 12 (FIG. 3) located above said sector are raised, with the clear passage of the outlet being thereby increased at this section. A greater flow of charge will therefore pass through this sector of the outlet, with the amount of the charge at this particular section of the furnace top 27 (FIG. 1) increasing accordingly. This will be accompanied by accumulation of fines in this place, i.e. peripheral charge segregation at the top 27 will be attained.

It is preferable that at least two sector shields 12 be used, insofar as one shield is not able to close the clear passage of the outlet of the hopper 9. More than twelve sector shields 12 are inexpedient, as their control becomes too complicated and their functional reliability diminishes. In the meantime the required charge accumulation can be provided during its supply at any point round the circumference of the furnace top 27. To this end two adjacent sector shields 12 (FIG. 3) are raised to a different height, e.g. a shield (a) is raised completely and a shield (b) only partly.

Radial charge segregation at the furnace to 27 (FIG. 1) is controlled with the help of the distributing bell 16 (FIGS. 12 and 13). In order to feed fines to the periphery and coarse fractions to the centre, the bell 16 (FIG. 12) is raised to a mark (e). Then the flow of charge will be deflected to the walls of the hopper 6, the charge running at the angle of repose to the center, this resulting in accumulating the fines at the walls of the hopper 5 and the coarser fractions in its central part. As the charge is lowered from the hopper 2 (FIGS. 14 and 15) into the furnace, its radial distribution pattern at the furnace top 27 (FIG. 1) is essentially not changed.

To enable still better preservation of the radial charge distribution pattern at the furnace top 27 optimized angles of inclination of the generatrices of the bell 1 and hopper 2 are selected.

For charging the coarse fractions to the periphery and the fines to the center, the distributing bell 16 (FIG. 13) is lowered to a level (f). In that case the charge will be firstly poured to the center, where an accumulation of the fines will be formed, whereafter it will slip at the angle of repose to the walls of the hopper 5, where the coarse fractions will be found.

To enable local peripheral accumulation of the sinter at the furnace top 27 (FIG. 11), the sinter is poured into the hopper 2 with the distributing bell 16 raised to the level (e), the coke being dropped with the bell 16 lowered to the level (f). In this case the best results in terms of radial sinter and coke distribution are attained by lowering a sinter batch (a skipload) followed by a coke batch, whereupon the cycle is repeated by descending again firstly the sinter batch and then the coke batch, each batch being lowered separately on the bell 1 (FIG. 14). Where a need arises to supply the sinter (A) (FIG. 15) to the center and the coke (K) to the periphery, a reversed loading sequence is followed in supplying the charge onto the large bell 1.

For charging coarse sinter fractions to the center and coarse coke fractions to the periphery of the furnace top 27 (FIG. 1), batchwise charging (by loading separate charges) is resorted to, i.e. at first only the sinter is charged on the large bell 1 with the bell 16 raised to the level (e), whereafter, upon dropping the sinter on the furnace top 27, only the coke is charged onto the large bell 1 with the bell 16 being lowered to the level (f).

For charging one or another fraction in the middle of the radius or into some other part of the furnace top 27 (FIG. 1) the bell 16 is set to an intermediate position between the levels (e) and (f) or some other sequence of operations is employed in supplying the charge constituents into the bell. To ensure more uniform peripheral distribution of the charge at the furnace top 27 the bell 16 can be rotated or its surface can be bladed.

Both the size and configuration of the annular gap 15 can be varied without stopping the charging of a blast furnace. To this end the locators 49 (FIG. 9) are carried off and the grate bars 44 are drawn out to be replaced by new ones with the ribs 46 of a requisite configuration.

With the receiving hopper 9 (FIG. 11) arranged above the bottom (large) bell 1, the charge constituents are blended to a lesser degree as the charge descends to the level 28 in the blast furnace, but it complicates the control over the functioning of the charging mechanisms. In this case the top bell can be replaced by the bunkers 50 (FIG. 10) with the gas-sealing valves 51.

The herein-proposed charging device has a broad control and radial charge distributing range at the furnace top 27 until the dumping action of the large bell 1 is initiated and the charge drops into the blast furnace to the level 28.

Large-capacity blast furnaces of today employ large bells up to 8 m in diameter, which appreciably complicates the manufacture, handling and erection of such bells. According to this invention, a possibility is provided to reduce the diameter of the large bell 1.

Owing to more regular radial and peripheral distribution of the charge at the top 27 and a possibility of selecting and supplying the whole round of charges onto the top bell, a more stable gas flow is provided in the furnace, thermal distortion of the charging equipment and, hence, gas release to the atmosphere and abrasive wear of contact surfaces are decreased. This contributes to a longer service life of the charging devices.

The charging device of the invention is noted for a simple and reliable construction, providing for the most favorable radial and peripheral distributing of the stock at the furnace top; it enhances also the durability of the bell-and-hopper arrangements and makes it possible to cut down the diameter of a large bell.

Moreover, the reliability of operation of the charging device is enchanced, as it does not comprise rapidly rotating charge-dispensing gears; charge grinding is decreased.

What we claim is:

1. A charging device for a blast furnace comprised of a receiving hopper having an outlet therein, at least one rod disposed along the longitudinal axis of said hopper and extending through said outlet, a plurality of coupling rods disposed above said rod to support said rod, a plurality of guard rings disposed on said rod, at least one of said rings having a funnel-shaped outer surface and being disposed at the location of said outlet of said hopper, means for adjusting the cross-sectional area and shape of said outlet including a plurality of sector shields, a plurality of guideways slidably engaging said sector shield, said sector shields being disposed about said tapered guard ring defining a funnel shaped annular opening therearound and being adjustable in size, means for laterally displacing each said shield such that lateral displacement of each shield along said guideways changes the size and shape of said hopper outlet.

2. A charging device as in claim 1, wherein said means for adjusting the size and shape of the outlet of said receiving hopper comprises from 2–12 sector shields.

3. A charging device as in claim 1, wherein the bottom edges of said sector shields create a formation around said guard ring of an annular gap which is at least 1.5 times less than that between the bottom edge of said receiving hopper outlet and said rod guard rings, but is greater that a gap which may cause the hanging of the charge in said receiving hopper.

4. A charging device as in claim 1, wherein said tapered guard ring is made as a distributing bell, linked mechanically with a drive means for shifting it along said rod, the top part of said distributing bell carrying a cylindrical guard ring above which is arranged a guard ring whose external surface is shaped as a one-sheet hyperboloid.

5. A charging device as in claim 1, wherein said means for adjusting the cross-sectional area and shape of said receiving hopper outlet is provided with a sensor, such that the sensor delivers a signal to the sector shield lateral displacement means.

6. A charging device as in claim 1, wherein the bottom edges of said sector shields are fitted with projections shaped as isosceles triangles disposed such that lateral sides of said triangular members are parallel to the adjoining lateral side edges of the adjacent members.

7. A charging device as in claim 6, wherein each said sector shield is manufactured as a frame to which strips of a wear-resistant material are secure.

8. A charging device as in claim 7, wherein each of said sector shield guideways includes a plurality of plates affixed thereto, said plates being affixed to a plurality of running gears.

9. A charging device as in claim 6, wherein said guideways have at each longitudinal end thereof a hull in which a pivot is provided with a detent attached thereto, said detent being shaped as a helix and positioned so as to engage said running gears.

* * * * *